United States Patent [19]

Kontis et al.

[11] 4,421,008

[45] Dec. 20, 1983

[54] TIMED ROUND STOP FOR A SPROCKET FED WEAPON

[75] Inventors: George E. Kontis, South Burlington; Sherwood P. Evans, Burlington, both of Vt.

[73] Assignee: The United States of America as represented by the Secretary of the Army, Washington, D.C.

[21] Appl. No.: 296,738

[22] Filed: Aug. 27, 1981

[51] Int. Cl.[3] ..... F41D 10/06

[52] U.S. Cl. ..... 89/33 CA

[58] Field of Search ..... 89/33 R, 33 BC, 33 CA, 89/33 BB

[56] References Cited

U.S. PATENT DOCUMENTS

| | | | |
|---|---|---|---|
| 2,453,786 | 11/1948 | Dixon | 89/33 CA |
| 2,481,726 | 9/1949 | D'Assis-Fonseca | 89/33 BC |
| 3,136,213 | 6/1964 | Reed | 89/33 CA |
| 4,043,249 | 8/1977 | Rocha | 89/33 CA |
| 4,244,271 | 1/1981 | Gaboriault | 89/33 BB |

FOREIGN PATENT DOCUMENTS

| | | | |
|---|---|---|---|
| 599482 | 3/1948 | United Kingdom | 89/33 CA |

*Primary Examiner*—Donald P. Walsh

*Assistant Examiner*—Donald G. Kelly

*Attorney, Agent, or Firm*—Robert P. Gibson; Anthony T. Lane; Max Yarmovsky

[57] ABSTRACT

A timed round stop for a sprocket fed weapon is disclosed. The round stop is pivotable into and out of the ammunition feed path responsive to a control mechanism, for preventing a round being fed to the stripper bolt of the weapon before the stripper bolt is in the correct position to receive it. The control mechanism preferably comprises a ratchet having the same number of teeth as the feed sprocket and mounted for rotation about the same axis and at the same speed as the latter. Rotation of the control ratchet brings each of its teeth sequentially into engagement with a control surface of the round stop. During such engagement, the round stop is held in a position where it blocks the feed path. Further rotation of the ratchet terminates the engagement, and the round stop can then simply be pushed out of the way by the round of ammunition. The round stop and the control mechanism involve no springs or other elastic elements whose functioning could be impaired by heavy vibration or surging of the ammunition belt. The timed round stop can be used successfully with ammunition linked with different pitches.

9 Claims, 7 Drawing Figures

TIMED ROUND STOP FOR A SPROCKET FED WEAPON

GOVERNMENTAL INTEREST

The invention described herein was made in the course of a contract with the Government and may be maufactured, used and licensed by or for the Government for governmental purposes without the payment to us of any royalties thereon.

BACKGROUND OF THE INVENTION

The present invention pertains generally to round stops for automatic weapons, and pertains in particular to a timed round stop for a sprocket fed weapon.

In one type of conventional machine gun feeder, ammunition linked together to form a belt is fed into the weapon by means of a single feed sprocket. The feed sprocket rotates, each tooth thereof engaging one round and pushing the round into engagement with the stripper bolt at a feed transfer position. The stripper bolt is a reciprocating element which delivers each round in sequence to be chambered and fired. As the stripper bolt moves the round from the feed transfer position, fixed guide surfaces which are associated with the stripper bolt engage the links that join each round to the next and strip them off the round for ejection from the weapon. Because the stripper bolt is a reciprocating element, it can accept a round of ammunition only while in the feed transfer position. If the round fed by the feed sprocket arrives at the feed transfer position before the stripper bolt, a feed jam occurs.

This problem is accentuated in weapons, such as the GE-150, made by the General Electric Co., that are equipped with feeders designed to accept ammunition linked with either of two different links, such as the M-9 link and the M15A2 link. The feed sprocket teeth are designed to fit tightly between rounds linked with the shorter-pitched link, in the case of the example the M-9 link, to maximize round control and minimize the above-described problem. The pitch of the M15A2 link is about 0.090 inch greater than that of the M-9 link, which results in reduced round control when the M15A2 link is employed. It is desirable to avoid the need for additional round control devices and separate feed sprockets for each link.

A related problem occurs during loading of the weapon. When rounds are loaded into weapons such as the GE-150, the feed sprocket is disengaged from its driver so that it can turn freely. During the loading the lead round could accidentally be inserted manually as far as the feed transfer location. This is undesirable since the stripper bolt may not be in the correct position to receive a round, resulting in a feed jam.

Round stops that cooperate with the feed sprocket to prevent these problems are well known. One typical arrangement is the GE-120C feeder, made by the General Electric Co., in which belted ammunition is fed from one of two feed sprockets to a feed tray in the bottom of the feeder. A spring-loaded round stop forces the round into a special slot and holds it there until the round is rammed into the chamber by the bolt.

Another anti-jam device is disclosed in U.S. Pat. No. 2,820,401, issued Jan. 21, 1958, to J. Gerick, for Machine Gun Anti-Jamming Device. In this device, a spring-loaded depressor which normally protrudes into the ammunition feed path is forced out of the path by the end of each tooth of the feed sprocket. A coil spring returns the depressor to its normal position after the sprocket tooth has cleared the depressor.

Conventional depressors and round stops typically rely on spring energy for at least half of their actuation cycle. For a high reliability weapon, this is undesirable, because the extreme vibrational loading that occurs during firing can cause a loss of round control and result in a malfunction. Moreover, any given conventional device is only suited for use with rounds linked together with a single pitch.

SUMMARY OF THE INVENTION

It is the primary object of the present invention to provide a round stop for use in a sprocket fed weapon which prevents feed jamming and avoids the disadvantages of the prior art devices.

It is another object of the invention to provide a round stop that does not rely on spring energy for any part of its actuation cycle.

It is still another object of the invention to provide a round stop that is well suited for use with ammunition linked together with either of two different pitches.

It is yet another object of the invention to provide a round stop that is automatically actuated during the loading process to permit loading and downloading of the weapon without the possibility of rounds being manually inserted too far into the weapon.

It is still another object of the invention to provide a round stop that can be actuated either by an automatic control mechanism, when the weapon is fired, or manually, for loading, and that does not require retiming to effect a transition between these two methods of actuation.

According to the present invention, a round stop is provided adjacent a feed sprocket in such a manner as to be pivotable into and out of the feed path of a round of ammunition being moved by the feed sprocket to the feed transfer location for engagement by the stripper bolt. A control mechanism is provided for the round stop, preferably comprising a ratchet mounted on the same shaft as the feed sprocket and having the same number of teeth as the latter. The round stop has a control surface, which is so shaped and located that as the ratchet rotates, each ratchet tooth or lobe in sequence engages the control surface and thereby forces the round stop to assume and retain a stop position in which it protrudes into the feed path. As long as the ratchet tooth continues to engage the control surface, the feed path is blocked. As the ratchet continues to rotate, however, the ratchet tooth eventually clears the control surface, and the round stop becomes free to pivot. The feed sprocket, urging the round toward the feed transfer position, causes the round to push the round stop out of the feed path. The timing of the device is determined by the shape and orientation of the round stop control surface, the radial length and the shape of the ratchet lobes, and the circumferential angular displacement between each ratchet tooth and the corresponding feed sprocket tooth. These parameters are selected to ensure that each round is detained by the round stop until exactly the right instant to ensure that the round will reach the feed transfer position when the stripper bolt is ready to receive it. The timed round stop of the invention, which requires no spring forces of any kind for its operation, is proof against feed jams occurring due to vibrations or to surging of the ammunition belt. Moreover, it has been found that this structure is equally well suited for use with rounds linked with different pitches. For example, it has been found that a timed round stop according to the invention can be used equally well with M-9 and M15A2 links. In addition, the invention can be used equally well with ammunition feeders which strip the rounds sideways, forward or to the rear, as well as with feeders for linkless ammunition.

The preferred embodiment of the present invention also comprises a second control mechanism for use during loading and downloading of the weapon. The second control mechanism preferably comprises a bar mounted transverse to the axis of the shaft. To load the weapon, the operator manually disengages the feed sprocket shaft from its driver by pulling the end of the shaft to displace it axially. In the normal operating position, the bar engages a groove in the shaft, preventing its axial displacement. When the weapon is to be loaded, the bar is manually slid along its length to a second position. The edge of the bar that engages the groove when in the normal position has formed in it an indentation which lies adjacent the shaft when the rod is in its second position. The indentation is sufficiently large to allow the shaft to be axially displaced to disengage it from the driver when the bar is in the load position. The bar has a load contact surface that projects from the forward side of the plate. The round stop has a load contact surface so located that when the bar is moved to the load position, its load contact surface engages the load contact surface of the round stop in such a manner as to pivot the round stop into the feed path and hold it there in the stop position. As a result, it is impossible for the ammunition to be inserted too far into the feeder by accident, as can often happen with conventional devices. When the bar is returned to its normal position after loading, the round stop is no longer held in the feed path by the bar but in the normal manner under the control of the ratchet.

Other objects and features of the invention will be apparent from the following description and the accompanying drawings.

DETAILED DESCRIPTION OF THE PREFERRED EMBODIMENT

Figure 1:
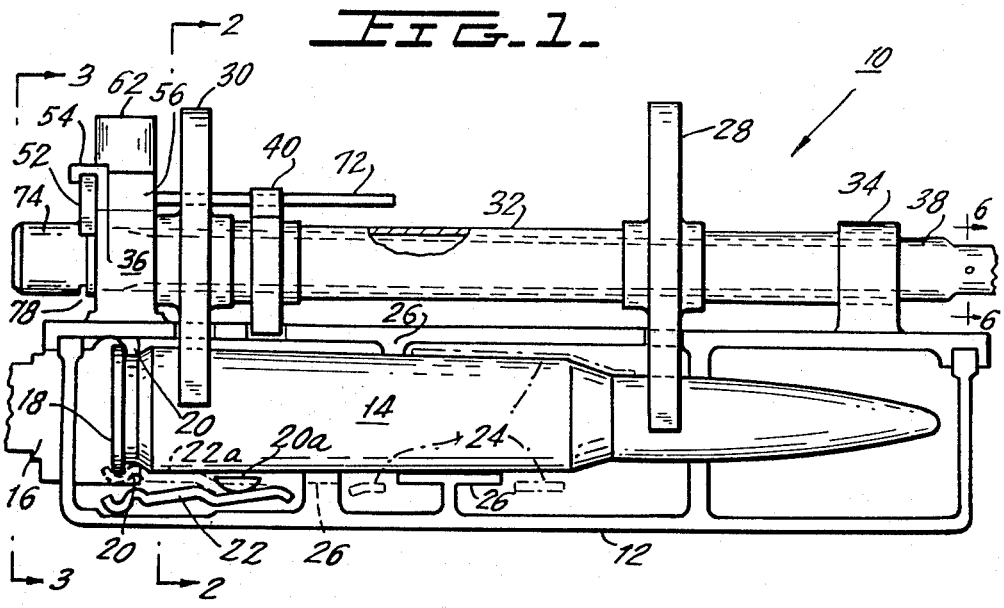
FIG. 1 is a view of the right-hand side of a feeder employing a feed sprocket and including one preferred embodiment of the timed round stop of the invention.

FIG. 1 shows a view from the right-hand side of a feeder 10 incorporating the timed round stop of the present invention. The feeder 10 includes a frame 12 defining a feed transfer position to which each round is sequentially fed for stripping prior to being chambered and fired. A stripper bolt 16 reciprocates along a path perpendicular to the direction of feed of the ammunition. At the forward end of its travel, the stripper bolt 16 is in the position shown in FIG. 1. If a round 14 is fed into the frame 12 when the stripper bolt 16 is in exactly the position shown, the rim 18 of the round 14 is engaged by grippers 20. As the round 14 is fed to the stripper bolt 16, link 22, which joins round 14 to the next round in the ammunition belt, is stripped from the round 14 by the stripper bar 20*a*. (The position of link 22 on round 14 before stripping is indicated in phantom at 22*a*.) Alternatively, the round 14 may be provided with a different type of link, shown in phantom at 24. In this case, when the stripper bolt 16 begins its rearward stroke, it pulls round 14 out of frame 12, resulting in the link 24 being stripped from the round 14 by protrusions 26 of frame 12. The stripper bolt 16 then delivers the round 14 for chambering and firing in a known manner.

Figure 6:
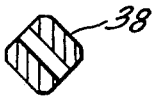
FIG. 6 is a cross-section of one portion of the sprocket shaft, taken from section line 6—6 of FIG. 1.

The round 14 is fed to the feed transfer position by means of forward and aft feed sprockets 28 and 30, respectively. Both feed sprockets 28, 30 are mounted on a sleeve 32, which is mounted for rotation in brackets 34, 36 and is splined to a shaft 38 whose forward end is disengageably received in a female driver (not shown). In the example shown, each sprocket 28, 30 has four teeth. The forward end of shaft 38, as shown most clearly in FIG. 6, is multi-sided, having one side for each tooth of the feed sprockets 28, 30.

The driver drives the feed sprockets 28, 30 with the proper timing to feed each round 14 into the feed transfer position when the stripper bolt 16 is at the forward end of its travel. It will be clear from the foregoing description that this is essential to the proper operation of the feeder. If the round 14 arrives in the feed transfer position ahead of the stripper bolt 16, the latter cannot grip the round 14 and a feed jam will occur. If round 14 is delivered too late, similarly, a jam will occur at the end of the next succeeding forward stroke of the stripper bolt 16. This problem is especially likely to occur in the case of a feeder 10 that is designed to be usable with rounds linked with either of two different pitches, such as the GE-150 feeder, which accepts both the M-9 and the M15A2 links, the difference in pitch between which is 0.090 inch.

Figure 2A:
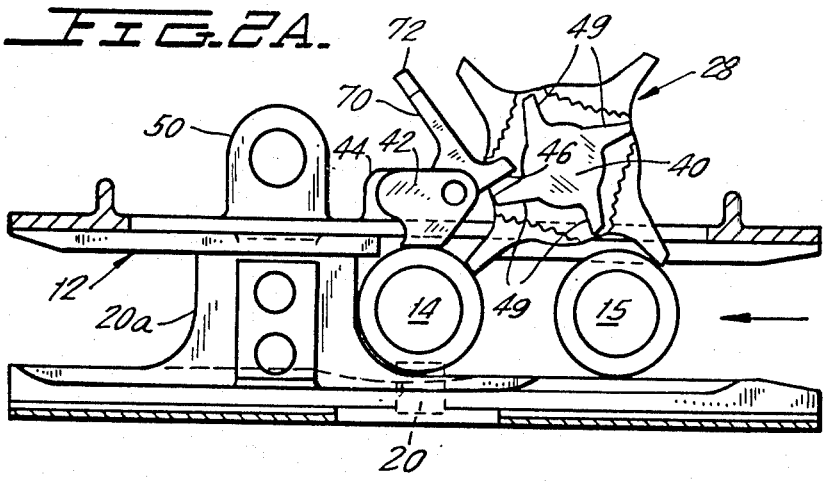
FIGS. 2A and 2B are sectional views of the embodiment of FIG. 1, taken from section line 2—2 in FIG. 1, and showing the timed round stop in operation.

In order to solve this problem and ensure that each round 14 is fed to the feed transfer location at exactly the right instant, a timed round stop is provided. According to the preferred embodiment shown, the timed round stop of the invention comprises a round stop ratchet 40 mounted on sleeve 32. The ratchet 40 has a number of teeth or lobes equal to the number of teeth on each feed sprocket 28, 30. The round stop 42 itself is mounted pivotally on a bracket 44 on frame 12 in such a manner that it can pivot into and out of the feed path of the rounds. The round stop 42 is provided with a control surface 46 which is so positioned that the rotation of the ratchet 40 brings each ratchet lobe 49 sequentially into engagement therewith. When the round 14 is in the position shown in FIG. 2B, the rotation of ratchet 40 with feed sprockets 28, 30 brings one ratchet lobe 49 into engagement with the contact surface 46, pivoting the round stop 42 down into the feed path of the rounds and preventing the round 14 from reaching the feed transfer position. The further rotation of ratchet 40 causes ratchet lobe 49 to clear control surface 46, as shown in FIG. 2A. Once this occurs, the round stop 42 is no longer held in the feed path, and the round 14 is able to push the round stop 42 aside and reach the feed transfer location as shown. At the same time, the feed sprockets 28, 30 engage the next round 15 and advance it toward the feed transfer position. The timing of the device is controlled by the dimensions of the feed sprockets 28, 30, the ratchet 40 and the round stop 42, and is such that each lobe of the ratchet 40 clears the control surface 46 of the round stop at exactly the right moment to allow the round to be driven into the feed transfer location just as the stripper bolt 16 reaches the forward end of its travel.

As mentioned in the section entitled "Background of the Invention", above, some feeders are designed to be fed either from the right or from the left. The feeder 10 illustrated in the Figures is such a device. In addition to brackets 34, 36, additional brackets 48, 50 are provided to receive the feed sprocket sleeve 32 and shaft 38. In addition, the bracket 44 is provided with two symmetrically placed apertures to receive the pivoting round stop 42. If it is desired to feed ammunition from the left, rather than from the right as shown, the feed sprockets 28, 30, the shaft 38, the sleeve 32, and the ratchet 40 are all transferred to brackets 48, 50, the stripper has a symmetric protrusion in order to receive rounds from the left rather than the right, and the round stop 42 is rotated 180° about a vertical axis and mounted for rotation in the left hand aperture of bracket 44.

Figure 3:
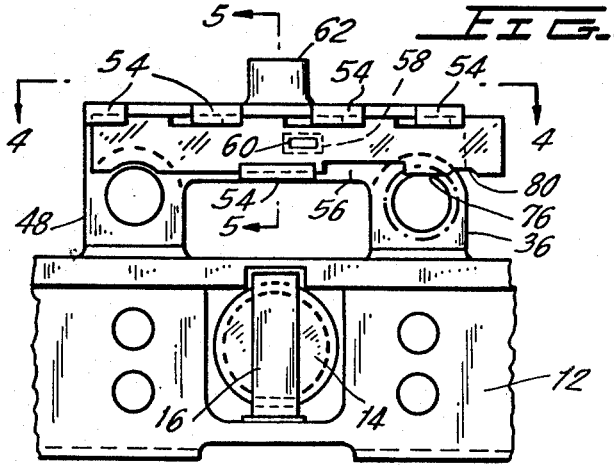
FIG. 3 is a view of the embodiment of FIG. 1 taken from line 3—3 in FIG. 1, with all moving parts except the second control element removed for clarity.
Figure 5:
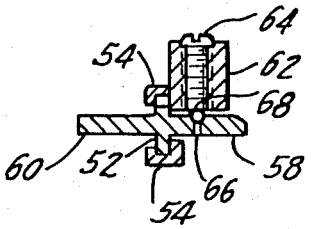
FIG. 5 is a cross-sectional view of the control bar taken along section line 5—5 of FIG. 3.
Figure 4:
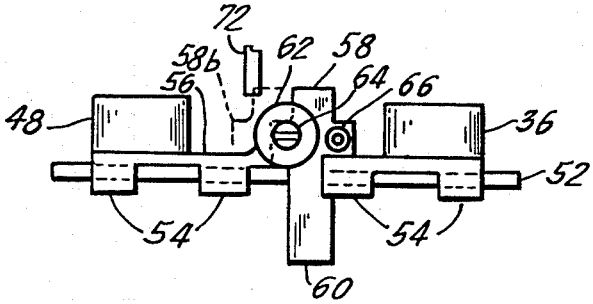
FIG. 4 is a view of a detail of the embodiment of FIG. 1, seen from line 4—4 in FIG. 3, and showing the second control bar, its mounting and its manner of engagement with the timed round stop.

As shown most clearly in FIGS. 3–5, the present invention also comprises a load-unload control mechanism comprising a bar 52 which is mounted in a vertical plane in such a manner as to be horizontally slidable. It is supported and held in place by brackets 54 which are provided on crosspiece 56 connecting brackets 36 and 48. The forward surface of the bar 52 is provided with a projection which serves as a load-unload bar contact surface 58. The aft surface of bar 52 is provided with a projection 60 which serves as a grip for the operator, as described below. Crosspiece 56 is provided with a small cylindrical housing 62 which receives a bolt 64. The upper surface of bar contact surface 58 is provided with two small apertures 66, which are adapted to cooperate in snap-fit engagement with a small protrusion 68 on the bottom of the bolt 64. By this means, the bar 52 can be locked in either of two horizontal positions. The normal operating position is that shown in FIGS. 3 and 4. For loading or unloading the weapon, however, the bar 52 is moved to the right or left (left to load in configuration shown in FIG. 3) by means of grip 60.

Figure 2B:
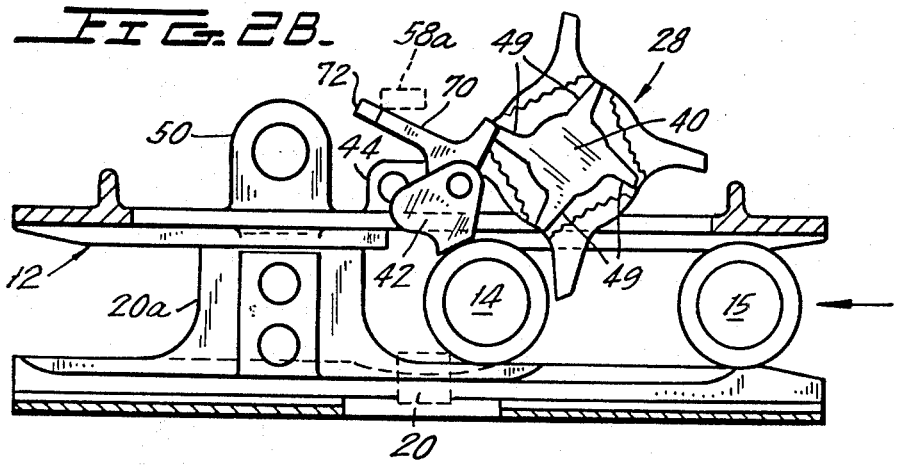

The round stop 42 is provided with a small projecting element 70 that extends perpendicular to the axis of shaft 38. The end of element 70 is provided with a round stop load contact surface 72 that extends forward and aft from element 70. The aft end of round stop load contact surface 72 is engaged by the bar contact surface 58 when the bar is moved to its load position, which is its left-hand position (in FIG. 3). Movement of the bar 52 to its load position moves the load bar contact surface 58 to the left, pivoting round stop load contact surface 72 (in the view of FIG. 2B) sufficiently far to rotate the round stop 42 into the feed path. This position is the same as the blocking or stop position that the round stop 42 assumes, as shown in FIG. 2B, when engaged by a lobe 49 of the ratchet 40. The position of bar contact surface 58 when the bar 52 is in its load position is indicated at **58*a*** in FIG. 2B.

The loading procedure will now be explained. Loading of the feeder 10 is effected by disengaging shaft 38 from its driver. The operator does this by gripping the knurled knob 74 and drawing the shaft to the left (in the view of FIG. 1). However, when the bar 52 is in its usual position, as shown most clearly in FIG. 3, its lower edge 76 is received in a groove 78 in the shaft 38 and so prevents the disengagement of shaft 38 from its driver. To load the weapon the operator therefore first moves bar 52 to the left (as seen in FIG. 3), to its load position, by means of grip 60. When the bar 52 is in its load position, an arcuate indentation 80 in its lower surface is aligned with shaft 38. The arcuate indentation 80 is sufficiently deep to permit the shaft 38 to be withdrawn axially aft by means of knurled knob 74 sufficiently far to disengage the shaft 38 from the driver. When the operator has done this, the feed sprockets 28, 30 are free to be turned manually, and the ammunition belt can now be fed into the feeder. When the bar 52 is moved to its load position, as explained above, the bar contact surface 58 moves to the position indicated as **58*b* in FIG. 4, engaging the round stop load contact surface 72 and forcing the round stop 42 into the feed path. It is accordingly impossible for the first round of the belt to be inserted into the feed transfer location by accidentally being inserted too far into the weapon. When the belt has been loaded, the shaft 38 is moved forward to re-engage the driver, and the bar 52 is then manually returned to its normal position by means of grip 60**.

Since the feed sprockets 28, 30 can rotate freely in either direction while shaft 38 is disengaged from the driver, downloading can also be performed using the loading procedure just described.

From the foregoing description and explanation, it will be clear that the use of the timed round stop of the present invention has the following advantages. First, the pivoting round stop is programmed to temporarily impede the motion of an incoming round, the round stop being controlled by means of a sprocket-like device rotating on the feed sprocket shaft. Second, when not required to impede round motion, the round stop is moved out of the round path by the round itself. Third, the round stop of the invention requires no springs to perform any part of its cycle, rendering a feeder that incorporates the present invention immune to malfunction due to vibrations or ammunition belt surging. Fourth, proper dimensioning of the round stop ratchet and the round stop control surface ensures that the round stop is held precisely in the stop position by the ratchet as the latter rotates. Fifth, the round stop is forced into its stop position automatically during the loading or downloading procedure. Sixth, the round stop can be moved into the stop position automatically by the ratchet or manually by means of the load-unload bar. The round stop of the invention does not require retiming when transitioning between these two methods of control.

The present invention may be embodied in other specific forms without departing from the spirit or essential attributes thereof and, accordingly, reference should be made to the appended claims, rather than to the foregoing specification, as indicating the scope of the invention.

We claim:

1. A timed round stop for a sprocket fed weapon, said round stop comprising:

feed means for sequentially feeding rounds along a feed path to a feed transfer position in a weapon for chambering of the rounds for firing;

pivoting round stop means having a first round stop position in which it blocks said feed path and a second round stop position in which it is remote from said feed path to allow movement of rounds therealong to said feed transfer position; and said round stop means having a first condition in which it is held in said first round stop position for preventing movement of a round past it along said feed path to said feed transfer position, and said round stop means having a second condition in which it is freely pivotable between said first and second round stop positions;

control means for placing said round stop means alternately in said first condition and in said second condition with a predetermined timing;

a control surface and wherein said control means comprises ratchet means having tooth means adapted to engage said control surface to place said round stop means in said first condition; and feed sprocket means having a number of teeth equal to the number of said tooth means of said ratchet means;

wherein said feed sprocket means and said ratchet means are mounted for rotation at the same rate about the same axis.

2. The timed round stop of claim 1, wherein said tooth means of said ratchet means each correspond to a respective said tooth of said feed sprocket means, said tooth means each being offset circumferentially from the respective said tooth of said feed sprocket means by a predetermined angle.

3. The timed round stop of claim 1, wherein said round stop means is mounted for pivoting between said first and second round stop positions about a second axis parallel to said first axis.

4. The timed round stop of claim 3, further comprising load-unload control means for placing said round stop means in said first condition for loading and unloading of the weapon.

5. The timed round stop of claim 4, wherein said round stop means has a load contact surface and said load-unload control means has a contact surface for engaging said load contact surface of said round stop means for placing said round stop means in said first condition for loading and unloading.

6. The timed round stop of claim 5, wherein said round stop means is mounted for pivoting about one axis and comprises a member extending parallel to said one axis and defining said load contact surface.

7. The timed round stop of claim 6, wherein said feed means comprises a shaft mounted for rotation about an additional axis parallel to said one axis and engageable to the drive of the weapon; said load-unload control means having a normal position in which it holds said shaft in a first axial position for engagement with the drive of the weapon, and said load-unload control means having a load position in which it releases said shaft to allow said shaft to be moved axially away from said first position for disengagement from the drive of the weapon; said load-unload control means, when in said load position, also engaging said load contact surface of said round stop means to maintain said round stop means in said first condition for loading and unloading.

8. The timed round stop of claim 7, wherein said round stop means is inelastic.

9. The timed round stop of claim 8, wherein said control means is inelastic.

* * * * *